US009476420B2

(12) United States Patent
Makino

(10) Patent No.: US 9,476,420 B2
(45) Date of Patent: Oct. 25, 2016

(54) SUPPLY PUMP

(71) Applicant: DENSO CORPORATION, Kariya, Aichi-pref. (JP)

(72) Inventor: Tadaaki Makino, Nukata-gun (JP)

(73) Assignee: DENSO CORPORATION, Kariya (JP)

( * ) Notice: Subject to any disclaimer, the term of this patent is extended or adjusted under 35 U.S.C. 154(b) by 590 days.

(21) Appl. No.: 13/736,182

(22) Filed: Jan. 8, 2013

(65) Prior Publication Data

US 2013/0202466 A1 Aug. 8, 2013

(30) Foreign Application Priority Data

Feb. 3, 2012 (JP) ..... 2012-021883

(51) Int. Cl.
*F04B 53/00* (2006.01)
*F04B 1/04* (2006.01)

(52) U.S. Cl.
CPC ..... *F04B 53/00* (2013.01); *F04B 1/0426* (2013.01)

(58) Field of Classification Search
CPC .... F04B 1/0426; F04B 1/0439; F04B 9/047; F04B 53/14; F15B 15/1414; F02M 2041/1494; F02M 59/102; Y10T 29/49304; F01L 1/14
USPC ..... 123/90.5
See application file for complete search history.

(56) References Cited

U.S. PATENT DOCUMENTS 2,079,821 A * 5/1937 Scribner ..... 92/136
2,131,779 A * 10/1938 Zwick et al. ..... 417/494
2,188,859 A * 1/1940 Edwards ..... 92/129
2,980,092 A * 4/1961 Dreisin et al. ..... 123/449
3,314,303 A 4/1967 Maat
3,999,529 A * 12/1976 Davis ..... 123/449
4,091,841 A * 5/1978 Beneker ..... F16L 55/13 138/89
4,412,519 A * 11/1983 Hoch et al. ..... 123/449
4,565,320 A * 1/1986 Taniguchi et al. ..... 239/90
5,779,085 A * 7/1998 Havlinek et al. ..... 220/234
7,926,693 B2 * 4/2011 Schramm ..... 228/4.1
2010/0000476 A1 * 1/2010 Kunz et al. ..... 123/90.5

(Continued)

FOREIGN PATENT DOCUMENTS

DE 1806336 * 7/1958 ..... F02M 59/02
DE 1 806 336 2/1960
DE 1 099 795 2/1961

(Continued)

OTHER PUBLICATIONS

DE 1099795 Machine Translation.*

(Continued)

*Primary Examiner* — Michael Leslie
*Assistant Examiner* — Dustin T Nguyen
(74) *Attorney, Agent, or Firm* — Nixon & Vanderhye P.C.

(57) ABSTRACT

A supply pump includes a housing, a tappet and an anti-rotation pin. The housing has a cylindrical slide wall and an attachment hole. The tappet is provided in the housing to be slidably reciprocatable along the slide wall, and the tappet has an elongated hole. The anti-rotation pin includes an end pin inserted into the attachment hole to be attached to the housing, and a plug fixed to the housing to prevent the end pin from dropping out of the attachment hole. The end pin is fitted into the elongated hole of the tappet to prevent the tappet from rotating with respect to the housing. The end pin is provided separately from the plug.

15 Claims, 3 Drawing Sheets

(56) References Cited

U.S. PATENT DOCUMENTS

| | | | | |
|---|---|---|---|---|
| 2010/0020124 | A1* | 1/2010 | Okazaki | B41J 2/16532 347/29 |
| 2010/0024779 | A1 | 2/2010 | Makita | |

FOREIGN PATENT DOCUMENTS

| | | | | |
|---|---|---|---|---|
| DE | 1099795 | * | 2/1961 | F02M 59/102 |
| DE | 21 21 615 | | 11/1972 | |
| DE | 10 2005 046 670 | | 4/2007 | |
| DE | 102005046670 | * | 4/2007 | F02M 59/02 |
| DE | 10 2010 030 792 | | 1/2012 | |
| GB | 1 329 535 | | 9/1973 | |
| JP | 59-063361 | | 4/1984 | |
| JP | 60-100564 | | 7/1985 | |
| JP | 62-90977 | | 6/1987 | |
| JP | 05-061402 | | 8/1993 | |
| JP | 2009-236033 | | 10/2009 | |
| WO | WO 03046379 A1 | * | 6/2003 | F04B 1/04 |
| WO | WO 2007107410 A1 | * | 9/2007 | F02M 59/102 |

OTHER PUBLICATIONS

DE 102005046670 Machine Translation.*

DE 1806336 Machine Translation.*

Office Action (2 pages) dated Jan. 7, 2014, issued in corresponding Japanese Application No. 2012-021883 and English translation (3 pages).

Chinese Office Action (6 pages) dated Oct. 10, 2014, issued in corresponding Chinese Application No. 2013-10027420.4 and English translation (4 pages).

Office Action (6 pages) dated May 15, 2015, issued in corresponding German Application No. DE 10 2013 100 848.8 and English translation (5 pages).

* cited by examiner

SUPPLY PUMP

CROSS REFERENCE TO RELATED APPLICATION

This application is based on and incorporates herein by reference Japanese Patent Application No. 2012-021883 filed on Feb. 3, 2012.

TECHNICAL FIELD

The present disclosure relates to a supply pump for supplying a fluid such as a high-pressure fluid, to prevent rotation of a tappet that reciprocates along a cylindrical slide wall.

BACKGROUND

A conventional technology for preventing rotation of a tappet in a supply pump is known (JP 62-090977 U). An exemplar technology for preventing rotation of a tappet in a supply pump is shown in FIG. 7. The supply pump in the exemplar technology includes a cylindrical tappet 106 and an elongated hole 109 provided in a lateral surface of the tappet 106, as shown in FIG. 7. The elongated hole 109 extends in an axial direction of the tappet 106. The supply pump further includes an anti-rotation pin 110 attached to a housing from outside, so that the anti-rotation pin 110 engages with the elongated hole 109 of the tappet 106 to prevent rotation of the tappet 106.

The anti-rotation pin 110 is inserted into an attachment hole provided in the housing to be fixed to the housing. Specifically, the anti-rotation pin 110 has a male screw portion 113 provided on an outer periphery of the anti-rotation pin 110, and the male screw portion 113 is screwed into a female screw portion provided on an inner periphery of the attachment hole of the housing. Accordingly, the anti-rotation pin 110 is fixed to the housing.

In the exemplar technology, when the anti-rotation pin 110 is attached to the housing, the anti-rotation pin 110 may be screwed in a state where positions of the anti-rotation pin 110 and the elongated hole 109 are misaligned. In other words, torque generated by the screwing of the anti-rotation pin 110 may applied on an outer periphery of the tappet 106. As a result, the tappet 106 may be damaged due to the assembling failure.

The anti-rotation pin 110 prevents the rotation of the tappet 106 by contacting the elongated hole 109 of the tappet 106. Thus, the tappet 106 may add a force (impact force) on the anti-rotation pin 110, and the anti-rotation pin 110 may be unfixed from the housing. Because of the unfixing of the anti-rotation pin 110, fuel may leaks from the attachment hole of the housing.

An end portion of the anti-rotation pin 110 contacts the elongated hole 109 of the tappet 106 to prevent the rotation of the tappet 106. Thus, the end portion of the anti-rotation pin 110 is required to be resistant to abrasion. Moreover, an outer side portion of the anti-rotation pin 110 is exposed to atmosphere. Hence, the outer side portion of the anti-rotation pin 110 is required to be resistant to corrosion. Accordingly, what the anti-rotation pin 110 is required is different in between the end portion contacting the tappet 106 and the outer side portion exposed to the atmosphere. Therefore, a heat treatment method and a surface treatment method for the anti-rotation pin 110 may be limited.

SUMMARY

It is an objective of the present disclosure to provide a supply pump that prevents failure of assembling an anti-rotation pin and prevents liquid leakage from the supply pump due to unfixing of the anti-rotation pin.

According to an aspect of the present disclosure, a supply pump includes a housing, a tappet and an anti-rotation pin. The housing has a cylindrical slide wall and an attachment hole. The tappet is provided in the housing to be slidably reciprocatable along the slide wall, and the tappet has an elongated hole. The anti-rotation pin includes an end pin inserted into the attachment hole to be attached to the housing, and a plug fixed to the housing to prevent the end pin from dropping out of the attachment hole. The end pin is fitted into the elongated hole of the tappet to prevent the tappet from rotating with respect to the housing. The end pin is provided separately from the plug.

BRIEF DESCRIPTION OF THE DRAWINGS

The disclosure, together with additional objectives, features and advantages thereof, will be best understood from the following description, the appended claims and the accompanying drawings, in which:

DETAILED DESCRIPTION

Figure 1:
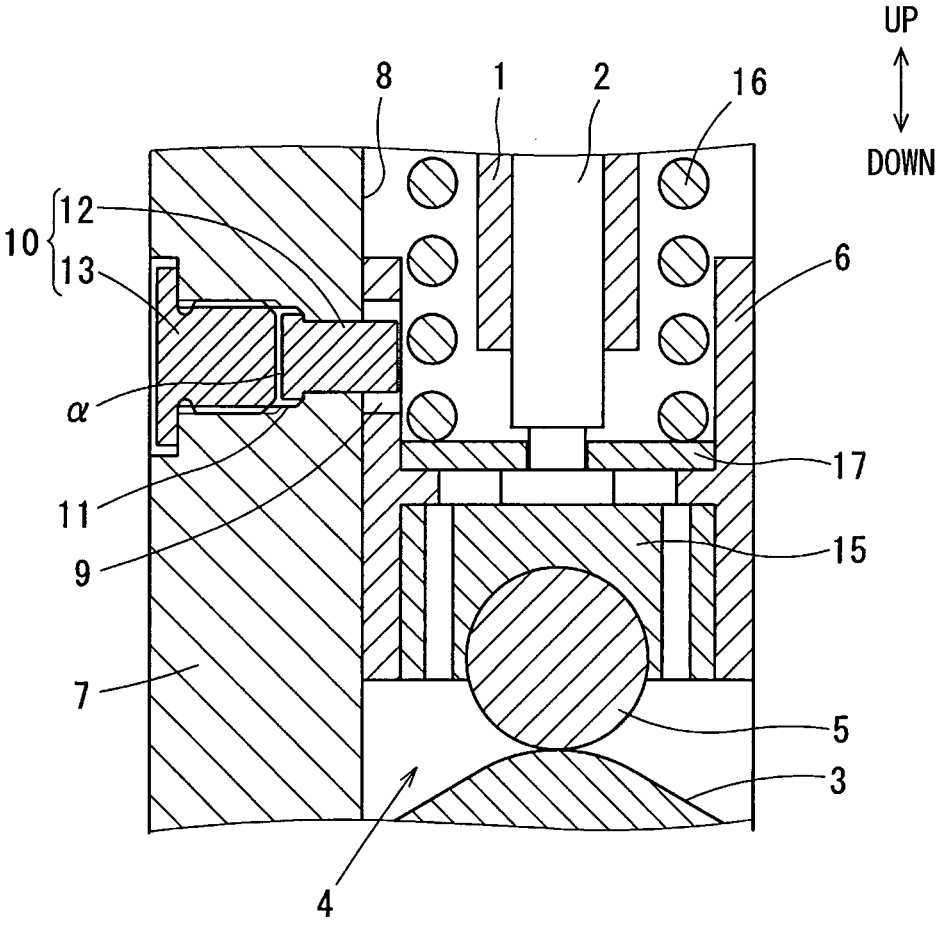
FIG. 1 is a sectional view showing a part of a supply pump according to a first embodiment of the present disclosure.

Embodiments of the present disclosure will be described hereinafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

First Embodiment

Figure 2:
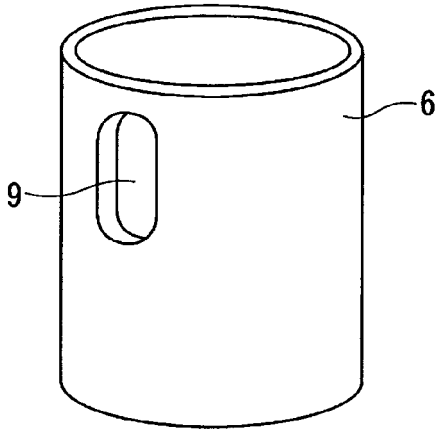
FIG. 2 is a perspective view showing a tappet of the supply pump having an elongated hole, according to the first embodiment.
Figure 3:
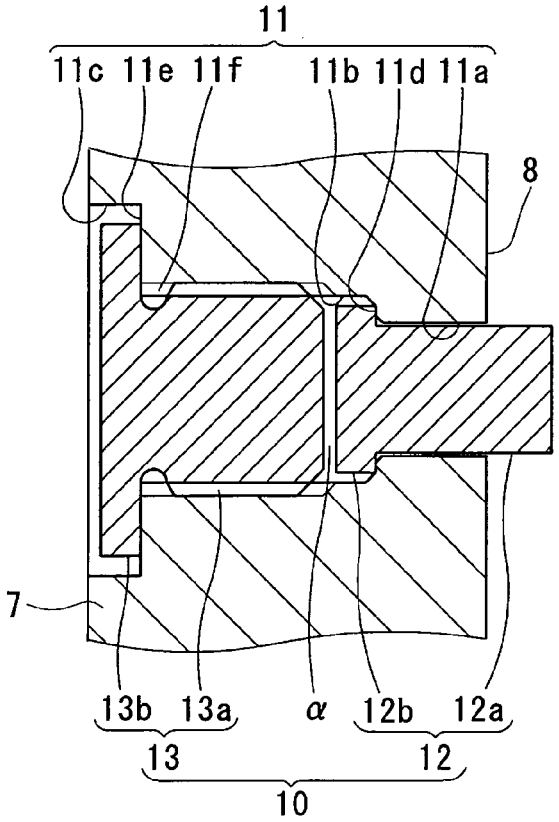
FIG. 3 is a sectional view showing an attachment hole and an anti-rotation pin of the supply pump according to the first embodiment.

A first embodiment will be described referring to FIGS. 1 to 3. An up-down direction shown by an arrow in FIG. 1 is only used for explanation of following embodiments, and is not related to an actual up-down direction in a state where the supply pump of the present disclosure is in use. Hence, the up-down direction described in the following embodiments is not limited.

A common rail system provided with a diesel engine (compression-ignition engine) includes multiple injectors that inject high-pressure fuel such as light oil or alcohol fuel into the engine, a common rail that accumulates the high-pressure fuel that is to be supplied to each of the injectors, a supply pump that pumps the high-pressure fuel to the common rail, a feed pump (low-pressure pump) that pumps fuel stored in a fuel tank to the supply pump, and a regulation valve that keeps a constant value of a pressure of the fuel supplied from the feed pump to the supply pump.

The supply pump includes a high-pressure pump that compresses fuel pumped by the feed pump into high-pressure fuel and discharges the high-pressure fuel, a pump driving portion that drives the high-pressure pump by utilizing rotation of the engine, and a fuel adjustment valve that adjusts a fuel amount supplied from the feed pump to the high-pressure pump.

The high-pressure pump includes a cylinder 1 having a cylinder wall that extends in the up-down direction (axial direction), and a plunger 2 that reciprocates in the up-down direction along the cylinder wall of the cylinder 1. When the plunger 2 moves downward, a fuel adjusted in its amount by the fuel adjustment valve is drawn into a compression chamber provided in an upper part of the cylinder wall. Subsequently, when the plunger 2 moves upward, the fuel in the compression chamber is compressed and transferred to the common rail via a check valve.

The pump driving portion includes a cam 3 housed in a lower part of a housing 7 of the supply pump to be rotary-driven by the engine, and a transmission portion 4 (power transmission mechanism) interposed between the plunger 2 and the cam 3. The transmission portion 4 transforms the rotation motion of the cam 3 into up-down motion, and transmits the up-down motion to the plunger 2.

The transmission portion 4 includes a roller 5 pressed against the cam 3 to be rotatable along a surface of the cam 3, a tappet 6 that has an approximately cylindrical shape and is supported to be slidable only in the up-down direction (i.e., a driven direction of the plunger 2), a shoe 15 provided between the roller 5 and the tappet 6 to support the roller 5 rotatably, a return spring 16 that urges the tappet 6 downwards, and a sheet 17 interposed between the return spring 16 and the tappet 6. As shown in FIG. 1, the sheet 17 is, more specifically, interposed between a lower end of the return spring 16 and a flange portion of the tappet 6 protruding radially inward. The sheet 17 is fixed to a lower end of the plunger 2 to transfer the up-down motion from the tappet 6 to the plunger 2.

The tappet 6 reciprocates in the up-down direction along a cylindrical slide wall 8 provided in the housing 7. When the cam 3 is rotary-driven by the engine, the roller 5 is displaced depending on a curved shape of the cam 3. The displacement of the roller 5 causes both the tappet 6 and the plunger 2 to reciprocate in the up-down direction.

A rotational axis of the roller 5 is required to be parallel to a rotational axis of the cam 3. In the first embodiment, the rotational axis of the roller 5 is always kept parallel to the rotational axis of the cam 3 by preventing the tappet 6 from rotating with respect to the housing 7. Specifically, in the first embodiment, an anti-rotation pin 10 is attached to the housing 7, and a part of the anti-rotation pin 10 is fitted into an elongated hole 9 of the tappet 6 to prevent the tappet 6 from rotating with respect to the housing 7. The elongated hole 9 is provided in a lateral portion of the tappet 6, and has an opening elongated in the up-down direction on a lateral surface of the tappet 6, as shown in FIG. 2.

A length of the elongated hole 9 in the up-down direction is longer than a length of strokes of the tappet 6 in the up-down direction, so that upper and lower ends of the elongated hole 9 do not contact the anti-rotation pin 10. In other words, the upper and lower ends of the elongated hole 9 are separated from the anti-rotation pin 10 by predetermined spaces. A width of the elongated hole 9 in a right-left direction (i.e., a width of the elongated hole 9 in a circumferential direction of the tappet 6) is slightly larger than a diameter of the end part of the anti-rotation pin 10 fitted into the elongated hole 9. Accordingly, rotation of the tappet 6 in the circumferential direction thereof is restricted. Inner surfaces of the elongated hole 9 in its width direction may contact the end part of the anti-rotation pin 10 so that the rotation of the tappet 6 is restricted.

The anti-rotation pin 10 is inserted into an attachment hole 11 provided in the housing 7. The attachment hole 11 is a through hole through which an inner surface of the slide wall 8 communicates with an outer surface of the housing 7. Specifically, as shown in FIG. 3, the attachment hole 11 extends perpendicular to the inner surface of the slide wall 8, and has a small hole portion 11*a*, a middle hole portion 11*b* and a large hole portion 11*c* which are different from one another in diameter. The small hole portion 11*a*, the middle hole portion 11*b* and the large hole portion 11*c* are arranged in this order in a radial direction of the housing 7 outward. In other words, the small hole portion 11*a* is arranged radially inward of the middle hole portion 11*b*, and the middle hole portion 11*b* is arranged radially inward of the large hole portion 11*c*, as shown in FIG. 3.

The attachment hole 11 further has a small diameter step 11*d* provided in a boundary portion between the small hole portion 11*a* and the middle hole portion 11*b*, and a large diameter step 11*e* provided in a boundary portion between the middle hole portion 11*b* and the large hole portion 11*c*. The attachment hole 11 further has a female screw portion 11*f* provided in a radially inner surface of the middle hole portion 11*b* such that a plug 13 can be fixed to the housing 7. The large diameter step 11*e* is a surface (seat surface) against which a flange portion 13*b* of the plug 13 is pressed for sealing the small hole portion 11*a*, and the large diameter step 11*e* is thereby made to be flat to prevent fuel leakage.

The anti-rotation pin 10 includes an end pin 12 that has the end part fitted into the elongated hole 9, and a plug 13 that prevents the end pin 12 from dropping out of the housing 7. The end pin 12 is provided separately from the plug 13. The end pin 12 is a member separated from the plug 13, and may be connected to the plug 13 after being formed separated from the plug 13.

The end pin 12 has a small pin portion 12*a* inserted into the small hole portion 11*a*, and a middle pin portion 12*b* inserted into the middle hole portion 11*b*. The end pin 12 further has a step provided in a boundary portion between the small pin portion 12*a* and the middle pin portion 12*b*, and the step of the end pin 12 contacts the small diameter step 11*d* to restrict a motion of the end pin 12 in the radial direction of the housing 7 inward.

A length of the small pin portion 12*a* in its axial direction (radial direction of the housing 7) is longer than a length of the small hole portion 11*a* in its axial direction (radial direction of the housing 7), so that the end part of the end pin 12 (the above-described end part of the anti-rotation pin 10) is fitted certainly into the elongated hole 9. Moreover, an outer diameter of the small pin portion 12*a* is slightly smaller than an inner diameter of the small hole portion 11*a*, so that a backlash between the small hole portion 11*a* and the small pin portion 12*a* is reduced.

The plug 13 has a male screw portion 13*a* (bolt portion) screwed into the female screw portion 11*f* of the attachment hole 11, and the flange portion 13*b* having an annular shape to seal the attachment hole 11. An outer end surface of the plug 13 (i.e., an outer surface of the flange portion 13*b*) in the radial direction of the housing 7 has a tool engagement portion (e.g., hexagon socket) with which a tool for fastening a plug can be engaged.

Lengths of the male screw portion 13*a* and the middle pin portion 12*b* in their axial directions (radial direction of the housing 7) are configured such that a clearance a is provided between the end pin 12 and the plug 13 in a state where the plug 13 is fastened completely into the female screw portion 11*f* (i.e., a state where the flange portion 13*b* is attached tightly to the large diameter step 11*e* so that liquid tightness is ensured).

Effects of the first embodiment will be described. The supply pump of the first embodiment includes the anti-rotation pin 10, and the anti-rotation pin 10 includes the end pin 12 and the plug 13 separately. Hence, when the end pin 12 is attached to the housing 7, it can be confirmed that the end pin 12 is fitted into the elongated hole 9 surely. Accordingly, assembling failure can be prevented. Therefore, damage of the tappet 6 due to the assembling failure can be prevented.

The end pin 12, which contacts the tappet 6 (elongated hole 9), and the plug 13, which prevents the end pin 12 from dropping out of the attachment hole 11, are provided separately in the supply pump of the first embodiment.

Accordingly, when the end pin 12 is subjected to a force from the tappet 6, the force on the end pin 12 can be prevented from transferring to the plug 13. As a result, unfixing of the plug 13 from the attachment hole 11 due to the force from the tappet 6 can be avoided, and fuel leakage because of the unfixing of the plug 13 can be thereby prevented.

Because the end pin 12 and the plug 13 are provided separately in the supply pump of the first embodiment, the end pin 12 and the plug 13 can be treated respectively so that the end pin 12 becomes superior in abrasion resistance and the plug 13 becomes superior in corrosion resistance. For example, the end pin 12 and the plug 13 may be made of iron respectively. Additionally, the end pin 12 required to have high abrasion resistance may be quenched, and the plug 13 required to have high corrosion resistance may be plated with zinc, nickel or zinc-nickel, for example. Because the end pin 12 and the plug 13 can be treated respectively and suitably, the abrasion resistance of the end pin 12 can be improved and the corrosion resistance of the plug 13 exposed to atmosphere can be enhanced.

Second Embodiment

Figure 4:
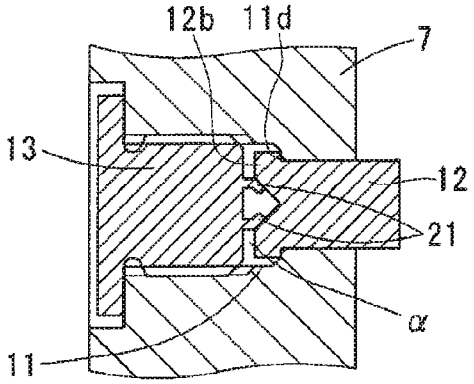
FIG. 4 is a sectional view showing an attachment hole and an anti-rotation pin of a supply pump according to a second embodiment of the present disclosure.

A second embodiment will be described with reference to FIG. 4. In the second embodiment, a protrusion portion 21 is provided in an end portion of a plug 13 as shown in FIG. 4, and the protrusion portion 21 is pressed to be deformed.

The protrusion portion 21 is deformable plastically and easily by torque generated when the plug 13 is screwed. For example, the protrusion portion 21 may have a thin hollow-cylindrical shape and may be provided at a center of the end portion of the plug 13, i.e., a center of a surface of the plug 13 opposed to an end pin 12. Moreover, the protrusion portion 21 may be integrated with the plug 13. Alternatively, multiple protrusions may be used as the thin protrusion portion 21. In the second embodiment, a conical depression is provided in the end pin 12 as shown in FIG. 4, so that a necessary force to deform the protrusion portion 21 is reduced when the protrusion portion 21 is pressed against the end pin 12.

In the second embodiment, the protrusion portion 21 is provided to the plug 13 as described above. Thus, the protrusion portion 21 can be plastically deformed between the end pin 12 and the plug 13, and a middle pin portion 12*b* of the end pin 12 can be pressed against the small diameter step 11*d*. Accordingly, rattle of the end pin 12 in an attachment hole 11 can be prevented. As a result, abrasion and noise generation due to the backlash between the end pin 12 and a housing 7 can be prevented. Furthermore, by providing the protrusion portion 21, an end portion of the end pin 12 can be certainly protruded inward in the radial direction of the housing 7, and a length of the end pin 12 inserted into an elongated hole 9 can be made largest.

Third Embodiment

Figure 5:
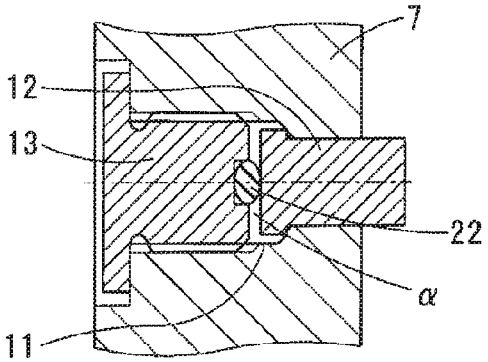
FIG. 5 is a sectional view showing an attachment hole and an anti-rotation pin of a supply pump according to a third embodiment of the present disclosure.

A third embodiment will be described referring to FIG. 5. In the third embodiment, as shown in FIG. 5, a buffer 22 is arranged between an end pin 12 and a plug 13 to be pressed against the end pin 12 and be deformed.

The buffer 22 is subjected to a torque generated when the plug 13 is screwed. The buffer 22 is deformed by the torque between the end pin 12 and the plug 13, and generates a restoring force. Specifically, as shown in FIG. 5, the buffer 22 of the present embodiment is attached to a recess portion provided at a center of an end portion of the plug 13, i.e., a center of a surface of the plug 13 opposed to the end pin 12. The buffer 22 is made of a resin material elastically deformable, such as rubber or silicon. A part of the buffer 22 protrudes toward the end pin 12.

Because the buffer 22 is provided between the end pin 12 and the plug 13 as described above, similar effects as in the above-described second embodiment can be obtained in the third embodiment. The buffer 22 is attached to the plug 13 in the third embodiment, but the buffer 22 is not necessarily attached to the plug 13. For example, (i) the buffer 22 may be provided separately from the end pin 12 and the plug 13, and may be held between the end pin 12 and the plug 13. (ii) The buffer 22 may be attached to the end pin 12 or the plug 13, or (iii) the buffer 22 may be provided to the end pin 12 or the plug 13 by embrocation or the like.

Fourth Embodiment

Figure 6A:
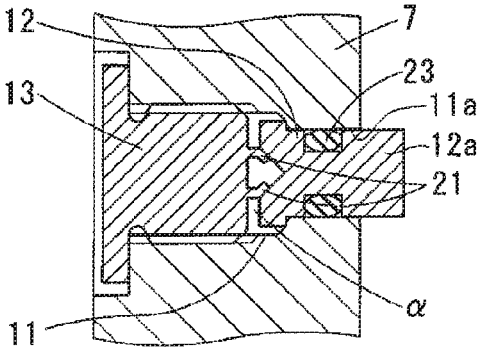
FIGS. 6A and 6B contain a sectional view showing an attachment hole and an anti-rotation pin of a supply pump according to a fourth embodiment of the present disclosure.
Figure 6B:
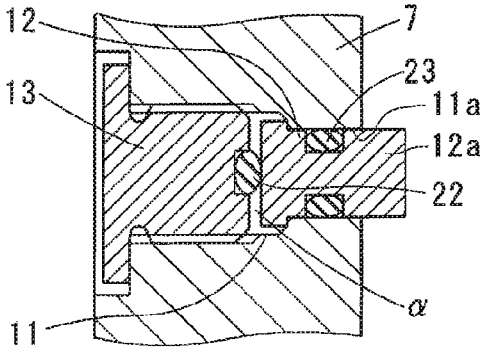
Figure 7:
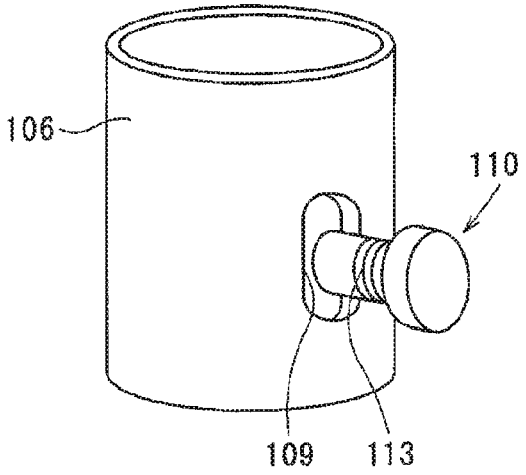
FIG. 7 RELATED ART
FIG. 7 is a perspective view showing a state in which an anti-rotation pin is attached to a tappet through an elongated hole, according to a related art.

A fourth embodiment will be described referring to FIGS. 6A and 6B. In the fourth embodiment, a seal ring 23 is provided around an end pin 12 to seal a gap between the end pin 12 and an inner surface of an attachment hole 11. Specifically, as shown in FIGS. 6A and 6B, the seal ring 23 is an O-ring set in a groove provided in an outer periphery of a small pin portion 12*a* of the end pin 12. The gap between the end pin 12 and the inner surface of the attachment hole 11, i.e., a gap between a small pin portion 12*a* of the end pin 12 and a small hole portion 11*a* of the attachment hole 11 is sealed by a restoring force of the seal ring 23. FIG. 6B shows a buffer 22 that is arranged between an end pin 12 and a plug 13 to be pressed against the end pin 12 and be deformed.

By providing the seal ring 23, the end pin 12 can be fixed firmly. As a result, abrasion and noise generation due to the backlash between the end pin 12 and a housing 7 can be prevented. Moreover, the seal ring 23 is capable of preventing fuel leakage from between the housing 7 and the end pin 12. Thus, even if the plug 13 is unfixed, the fuel leakage can be prevented. In FIGS. 6A and 6B, the seal ring 23 is applied to the supply pump of the second embodiment, but may be applied to the supply pumps of the other embodiments.

Although the present disclosure has been fully described in connection with the preferred embodiments thereof with reference to the accompanying drawings, it is to be noted that various changes and modifications as follows will become apparent to those skilled in the art. The above-described embodiments may be combined variously.

The fuel leakage may be prevented by providing a packing for sealing between the flange portion 13*b* and the housing 7.

The plug 13 is fixed to the housing 7 by screwing in the above-described embodiments, but the fixing method of the plug 13 to the housing 7 is not limited to this. The plug 13 may be fixed to the housing 7 by welding, press-fitting (thermal inserting), or crimping (deforming a part of the housing 7 plastically), for example.

In the above-described embodiments, the end pin 12 and the plug 13 are made of the same material, and are subjected to different treatments (e.g., quenching and plating) from each other. Alternatively, the end pin 12 and the plug 13 may be made of different materials from each other. For example, the end pin 12 may be made of stainless superior in abrasion resistance, and the plug 13, which is required to be formed into a screw shape, may be made of iron superior in work-easiness. Accordingly, abrasion resistance of the end pin 12 and work-easiness of the plug 13 can be improved. Furthermore, the end pin 12 and the plug 13 may be made of different materials from each other, and may be treated differently.

A technology for sealing a gap between the housing 7 and the plug 13 to prevent fuel leakage is not limited to the above-described embodiments in which the flange portion 13*b* is provided in the plug 13 to seal the attachment hole 11. For example, a variety of sealing technologies, such as welding, press-fitting, crimping and providing a packing, may be utilized to seal the attachment hole 11 to prevent the fuel leakage.

The supply pump of the present disclosure may be described as below. The supply pump is driven by an engine to compress and pump a fuel supplied into a compression compartment of the supply pump. The supply pump includes the high-pressure pump having the cylinder 1 in which the plunger 2 reciprocates to compress the fuel, and the pump driving portion that drives the plunger 2 so that the plunger 2 reciprocates by a driving force of the engine.

The pump driving portion includes the cam 3 rotary-driven by the engine, and the transmission portion 4 (driving-force transmission mechanism) interposed between the plunger 2 and the cam 3. The transmission portion 4 transforms the rotation motion of the cam 3 into linear motion, and transmits the linear motion to the plunger 2.

The transmission portion 4 includes the roller 5 that is pressed against the cam 3 to rotate along the surface of the cam 3, and the tappet 6 supported slidably in a direction of the linear motion (the driven direction of the plunger 2) to support the roller 5 rotatably.

The tappet 6 reciprocates along the cylindrical slide wall 8 provided in the housing 7, and the tappet 6 has the elongated hole 9 having the opening elongated in the axial direction on the outer surface of the tappet 6. The supply pump further includes the anti-rotation pin 10 that is attached to the housing 7 and is fitted into the elongated hole 9 to prevent the tappet 6 from rotating with respect to the housing 7. The anti-rotation pin 10 is inserted into the attachment hole 11 provided in the housing 7. The anti-rotation pin 10 includes the end pin 12 having the end portion fitted into the elongated hole 9, and the plug 13 that prevents the end pin 12 from dropping out of the housing 7. The end pin 12 and the plug 13 are provided separately.

Additional advantages and modifications will readily occur to those skilled in the art. The disclosure in its broader terms is therefore not limited to the specific details, representative apparatus, and illustrative examples shown and described.

What is claimed is:

1. A supply pump comprising:

a housing having a cylindrical slide wall, and an attachment hole;

a tappet provided in the housing to be slidably reciprocatable along the slide wall, the tappet having an elongated hole; and an anti-rotation pin including an end pin inserted into the attachment hole to be attached to the housing, and a plug fixed to the housing to prevent the end pin from dropping out of the attachment hole, the end pin being fitted into the elongated hole of the tappet to prevent the tappet from rotating with respect to the housing, wherein the end pin is provided separately from the plug, the plug has a protrusion portion that is pressed against the end pin to be deformed, the plug is located on an outer side of the end pin in a radial direction of the housing, the end pin is in direct contact with the elongated hole of the tappet, and the protrusion portion of the plug has a cylindrical shape and is deformable plastically.

2. The supply pump according to claim 1, wherein the plug has a male screw portion that is screwed into the attachment hole, and a flange portion that seals the attachment hole.

3. The supply pump according to claim 1, wherein the end pin is separated by a clearance from the plug.

4. The supply pump according to claim 1, further comprising a seal ring provided around the end pin to seal a gap between the end pin and the housing.

5. The supply pump according to claim 1, wherein the end pin and the plug have been subjected to different treatments from each other.

6. The supply pump according to claim 1, wherein the end pin and the plug are made of different materials from each other.

7. The supply pump according to claim 1, wherein the end pin has a tapered conical depression against which the protrusion portion of the plug is pressed.

8. A supply pump comprising:

a housing having a cylindrical slide wall and an attachment hole;

a tappet provided in the housing to be slidably reciprocatable along the slide wall, the tappet having an elongated hole;

an anti-rotation pin including an end pin inserted into the attachment hole to be attached to the housing, and a plug fixed to the housing to prevent the end pin from dropping out of the attachment hole, the end pin being fitted into the elongated hole of the tappet to prevent the tappet from rotating with respect to the housing, the end pin being provided separately from the plug; and a buffer made of a resin material and provided between the end pin and the plug to be pressed and deformed, wherein the plug has a recess portion into which the buffer is inserted, wherein the buffer has a circular shape in cross-section along an axial direction of the attachment hole, and wherein an outer circumferential surface of the buffer is pressed against an inner circumferential surface of the recess portion of the plug in a radial direction of the attachment hole.

9. The supply pump according to claim 8, wherein the resin material is elastically deformable.

10. The supply pump according to claim 8, wherein the resin material is rubber or silicon.

11. The supply pump according to claim 8, wherein a part of the buffer protrudes toward the end pin.

12. The supply pump according to claim 8, wherein the recess portion of the plug contacts the buffer in a radial direction of the attachment hole to restrict deformation of the buffer in the radial direction.

13. A supply pump comprising:

a housing having a cylindrical slide wall and an attachment hole;

a tappet provided in the housing to be slidably reciprocatable along the slide wall, the tappet having an elongated hole;

an anti-rotation pin including an end pin inserted into the attachment hole to be attached to the housing, and a plug fixed to the housing to prevent the end pin from dropping out of the attachment hole, the end pin being fitted into the elongated hole of the tappet to prevent the tappet from rotating with respect to the housing, the end pin being provided separately from the plug; and a seal ring provided around the end pin to seal a gap between the end pin and the housing, wherein the end pin has a groove on an outer peripheral surface, the seal ring is fitted into the groove of the end pin, a buffer made of a resin material and provided between the end pin and the plug to be pressed and deformed, the plug has a recess portion into which the buffer is inserted, the buffer has a circular shape in cross-section along an axial direction of the attachment hole, and wherein an outer circumferential surface of the buffer is pressed against an inner circumferential surface of the recess portion of the plug in a radial direction of the attachment hole.

14. The supply pump according to claim 13, wherein the gap is sealed by a restoring force of the seal ring.

15. The supply pump according to claim 13, wherein the seal ring is configured to prevent fuel leakage from between the housing and the end pin.

* * * * *